US006066034A

United States Patent [19]

Hettes et al.

[11] Patent Number: 6,066,034

[45] Date of Patent: May 23, 2000

[54] V-SHAPED FLAP DISC ABRASIVE TOOL

[75] Inventors: Frank J. Hettes, Greentown; Larry L. Mell, Lake Ariel, both of Pa.

[73] Assignee: Weiler Corporation

[21] Appl. No.: 09/210,046

[22] Filed: Dec. 11, 1998

[51] Int. Cl.[7] ..... B24B 9/02

[52] U.S. Cl. ..... 451/466; 451/465

[58] Field of Search ..... 451/463, 466, 451/465, 533, 537, 544, 547

[56] References Cited

U.S. PATENT DOCUMENTS

| | | | |
|---|---|---|---|
| Re. 22,457 | 3/1944 | Jeppson et al. . | |
| 237,472 | 2/1881 | Blackburn . | |
| 409,837 | 8/1889 | Hardie . | |
| 440,682 | 11/1890 | Wood . | |
| 1,022,692 | 4/1912 | Meyers . | |
| 1,377,598 | 5/1921 | Paoli . | |
| 2,033,263 | 3/1936 | Tone . | |
| 2,143,636 | 1/1939 | Tone . | |
| 2,223,864 | 12/1940 | Zublin . | |
| 2,268,663 | 1/1942 | Kuzmick . | |
| 2,444,093 | 6/1948 | Crumbling et al. . | |
| 2,576,364 | 11/1951 | Schloss . | |
| 2,680,335 | 6/1954 | Hurst . | |
| 2,819,567 | 1/1958 | Hall . | |
| 2,907,145 | 10/1959 | Hall, II et al. . | |
| 2,908,117 | 10/1959 | Hall . | |
| 3,049,843 | 8/1962 | Christensen . | |
| 3,110,579 | 11/1963 | Benson et al. . | |
| 3,461,563 | 8/1969 | Nelson . | |
| 3,597,884 | 8/1971 | Kaarlela . | |
| 3,616,581 | 11/1971 | Johnson et al. . | |
| 3,795,498 | 3/1974 | Hasegawa | 51/297 |
| 3,890,746 | 6/1975 | Saegusa et al. . | |
| 4,258,509 | 3/1981 | Wray et al. | 51/334 |
| 4,275,529 | 6/1981 | Teetzel et al. | 51/334 |
| 4,567,694 | 2/1986 | Sekiya et al. . | |
| 4,679,360 | 7/1987 | Eisenblätter . | |
| 4,718,204 | 1/1988 | Eisenblätter . | |
| 4,872,292 | 10/1989 | Block | 51/334 |
| 4,909,234 | 3/1990 | Matsuda . | |
| 4,993,194 | 2/1991 | Cadisch . | |
| 5,243,811 | 9/1993 | Kitabayashi et al. . | |
| 5,542,875 | 8/1996 | Ichiguchi . | |
| 5,722,881 | 3/1998 | Emerson | 451/466 |
| 5,752,876 | 5/1998 | Hettes . | |
| 5,871,399 | 2/1999 | Emerson | 451/466 |

FOREIGN PATENT DOCUMENTS

| | | |
|---|---|---|
| 1112878 | 11/1981 | Canada . |
| 153374 | 4/1892 | France . |
| 324620 | 4/1903 | France . |
| 360114469 | 6/1985 | Japan . |
| 360114470 | 6/1985 | Japan . |
| 60-157781 | 8/1985 | Japan . |
| 001576300 | 7/1990 | Russian Federation . |
| 001593938 | 9/1990 | Russian Federation . |
| 000336631 | 10/1930 | United Kingdom . |

OTHER PUBLICATIONS

Catalog, Weiler Tiger Abrasives, pp. 4,5,6,7, and 11.

Article, MAN Modern Application News, The Metalworking Idea Magazine, Jun. 1994, "Fibre Discs vs. Flap Discs."

*Primary Examiner*—Timothy V. Eley
*Assistant Examiner*—Dung Van Nguyen
*Attorney, Agent, or Firm*—Seidel, Gonda Lavorgna & Monaco, PC

[57] ABSTRACT

A flap disc for surface finishing a V-shaped work piece. The disc includes a backing plate and a plurality of abrasive flaps that are mounted on first and second sides of the backing plate. The abrasive flaps are radially disposed on the backing plate, each abrasive flap having an outer surface and an inner surface. A portion of the inner surface is adhesively attached to the backing plate. A second portion of the inner surface is disposed on the outer surface of an adjacent abrasive flap in an overlapping fashion so as to position the outer surface of the abrasive flap at an angle to the backing plate. The outer surfaces of the abrasive flaps on the first and second sides of the backing plate face in the same circumferential direction and taper radially toward one another to define a substantially V-shaped finishing surface.

8 Claims, 3 Drawing Sheets

V-SHAPED FLAP DISC ABRASIVE TOOL

FIELD OF THE INVENTION

The present invention relates to a surface finishing apparatus and, more particularly, to a rotatably driven surface finishing disc for use in sanding and polishing a V-shaped groove in a work surface.

BACKGROUND OF THE INVENTION

There are many different types of rotary surface finishing discs on the market, each designed for a particular aspect of a finishing process. Generally speaking, these finishing discs include abrasive particles which are attached to a backing, such as with adhesive. Typically, the abrasive particles are located on the side of the disc that is intended to come into contact with a work surface when the disc is mounted to a surface finishing tool.

Surface finishing tools generally include a motor which rotates the finishing disc. The abrasive particles are positioned on the disc to contact the work surface, scraping off the top coating or layer of the work surface. A common type of disc used with these sanders includes a fiber substrate onto which sharp, abrasive particles are securely bonded with a phenolic resin coating. The cured resin coating locks the sharp abrasive particles onto a fiber substrate.

The design of a rotary abrasive disc requires balancing the operational life of the disc against the "aggressiveness" of the abrasive. Aggressiveness relates to how much surface material is removed by the disc. In order to provide a high degree of aggressiveness, it is desirable to have relatively large abrasive particles on a rigid substrate, such as a resin fiber. However, an aggressive abrasive surface has drawbacks which limit its effectiveness. For example, during use, the larger abrasive particles, which are the first particles to contact the work surface, begin to wear and become dull, leading to the formation of flat spots on the disc. The flattened particles, too dull to continue to cut, "ride" on the work surface and prevent the smaller, still sharp, abrasive particles from contacting the work surface. This is commonly referred to as "glazing". Testing has shown that the flattening or glazing of as little as 10% of the disc surface may be sufficient to render the entire disc unusable. As a result, the disc must be replaced after a relatively short period of time. While it is possible for the operator to increase the amount of pressure exerted on the disc to force the smaller abrasive particles into contact with the work surface and, thereby increase the amount of cutting provided by the disc, the extra exertion will result in increased operator fatigue. Also, the build-up of non-cutting grit on the disk results in the development of excessive heat.

Another drawback to the use of resin fiber discs is that the material removed from the workpiece tends to become lodged between the large abrasive particles, "loading" the abrasive and preventing the abrasive particles from effectively cutting the surface. Consequently, during a typical surface finishing operation, an operator will be required to replace the abrasive disc several times due to wear. While changing one disc may only take several minutes to accomplish, the cumulative down-time involved in changing several discs can be quite significant.

Another problem with conventional surface finishing discs is that they are not designed to adequately finish interior corners on a work piece. The tight corner formed by converging surfaces of a work piece prevents a finishing disc from easily and efficiently sanding the interior corner. Currently, interior corners need to finished by inserting a one sided disc into the notch to sand one side of the surface. The tool is then reversed to permit the disc to sand the other side of the notch. This is a very time consuming and tedious process, and does not provide consistent surface finishing.

Furthermore, many conventional surface finishing discs are inefficient since only a portion of the finishing disc is in proper contact with the work surface. This portion wears considerably faster than the other portions of the disk that are not contacting or only minimally contacting the work surfaces. When a portion of the conventional disc has worn out, the entire disc must be replaced.

A new development in the field of sanding devices is the rotary flap disc which includes a series of rectangular abrasive flaps mounted around the circumference of a backing plate. The flaps utilized in these discs have abrasive particles adhesively bonded to a substrate, such as cotton or polyester cloth, by means of a phenolic resin. The unique feature of flap discs is that the rectangular abrasive flaps overlap one another in a stacked or shingled arrangement. As the exposed edges of the abrasive flaps begin to wear, the dull abrasive particles begin to break away from the substrate and are removed from the workpiece with the chips. The exposed fibers of the substrate quickly wear and break away, exposing the new abrasive particles on the underlying flap. Hence, the operator can continue to sand for a longer period of time before having to stop and change discs. As a result, the down-time in the sanding process is significantly reduced.

U.S. Pat. No. 5,752,876 discloses one very successful rotary flap disc design.

U.S. Pat. No. 5,752,876 is incorporated herein by reference in its entirety.

Although rotary flap discs are available on the market, the concept of a flap-type disc has not been applied to surface finishing discs for finishing odd shaped surfaces and interior corners, such as a V-shaped groove.

A need exists for an improved finishing disc which is designed to provide efficient and even finishing of an interior corner, such as a V-shaped groove, in a work piece.

SUMMARY OF THE INVENTION

The present invention is directed to a flap disc for surface finishing a V-shaped work piece. The disc includes a backing plate and a plurality of abrasive flaps that are mounted on first and second sides of the backing plate.

The abrasive flaps are radially disposed about the circumference of the backing plate. Each abrasive flap has an outer surface and an inner surface. A portion of the inner surface is adhesively attached to the backing plate. A second portion of the inner surface is disposed on the outer surface of an adjacent abrasive flap in an overlapping fashion so as to position the outer surface of the abrasive flap at an angle to the backing plate.

The outer surfaces of the abrasive flaps are mounted on the first and second sides of the backing plate so as to face in the same circumferential direction. The abrasive flaps define an abrasive surface on each side of the backing plate. The abrasive surfaces taper radially toward one another creating a substantially V-shaped finishing surface.

The foregoing and other features and advantages of the present invention will become more apparent in light of the following detailed description of the preferred embodiments thereof, as illustrated in the accompanying figures.

BRIEF DESCRIPTION OF THE DRAWINGS

For the purpose of illustrating the invention, the drawings show a form of the invention which is presently preferred.

However, it should be understood that this invention is not limited to the precise arrangements and instrumentalities shown in the drawings.

DETAILED DESCRIPTION OF THE PREFERRED EMBODIMENTS

Figure 1:
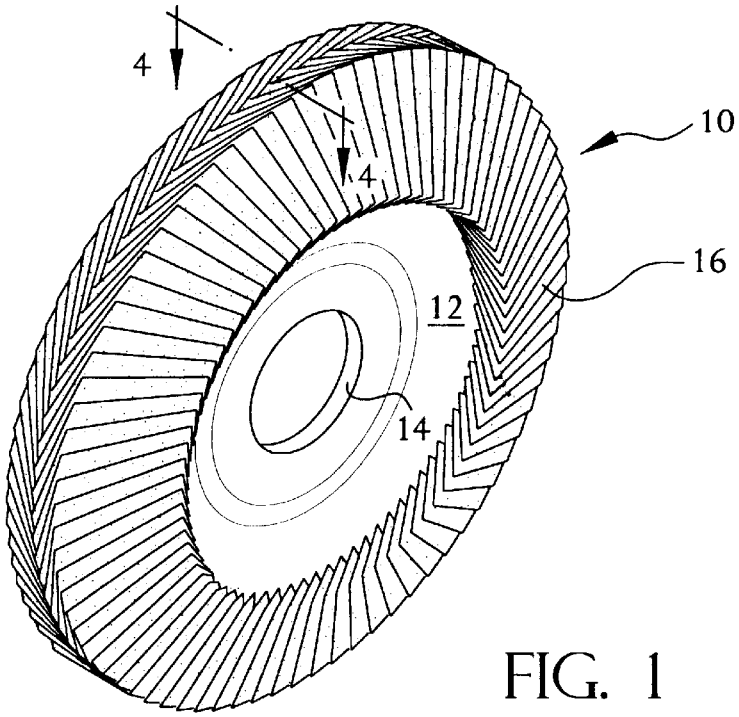
FIG. 1 is a perspective view of a V-shaped finishing disc according to the invention.

Referring now to the drawings, wherein like reference numerals illustrate corresponding or similar elements throughout the several views, FIG. 1 illustrates an isometric view of a surface finishing disc 10 according to the present invention, for use with a rotary surface finishing tool (not shown). The finishing disc 10 has a backing plate 12 with an aperture 14 formed through it for attaching the disc 10 to the finishing tool. More specifically, the aperture 14 is sized to accept a drive shaft from the surface finishing tool which transmits rotary motion to the disc 10. The aperture 14 is, preferably, centrally located so as to produce substantially circular motion of the disc 10 when rotated. The disc 10 also includes a plurality of abrasive flaps 16 arranged in an overlapping fashion on both sides of the disc 10 around its periphery or circumference. The abrasive flaps 16 are arranged such that, when the disc 10 is attached to a surface finishing tool and brought into contact with a work surface (not shown), the rotation of the disc 10 causes the abrasive flaps 16 to sand or abrasively wear away the work surface. The exposed portions of the abrasive flaps 16 define an abrasive surface on each side of the backing plate 12.

Figure 2:
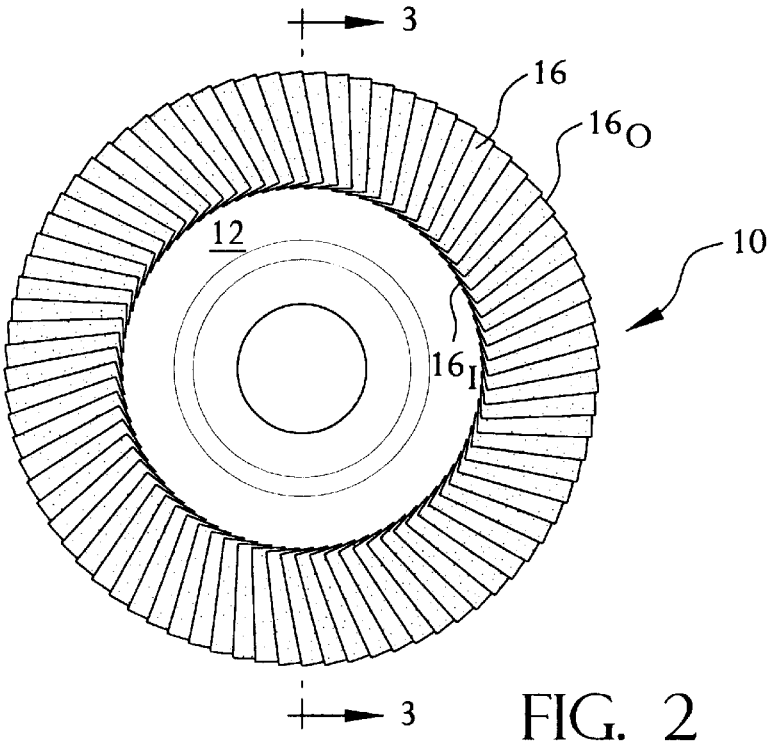
FIG. 2 is a plan view of the V-shaped finishing disc according to the invention.
Figure 3:
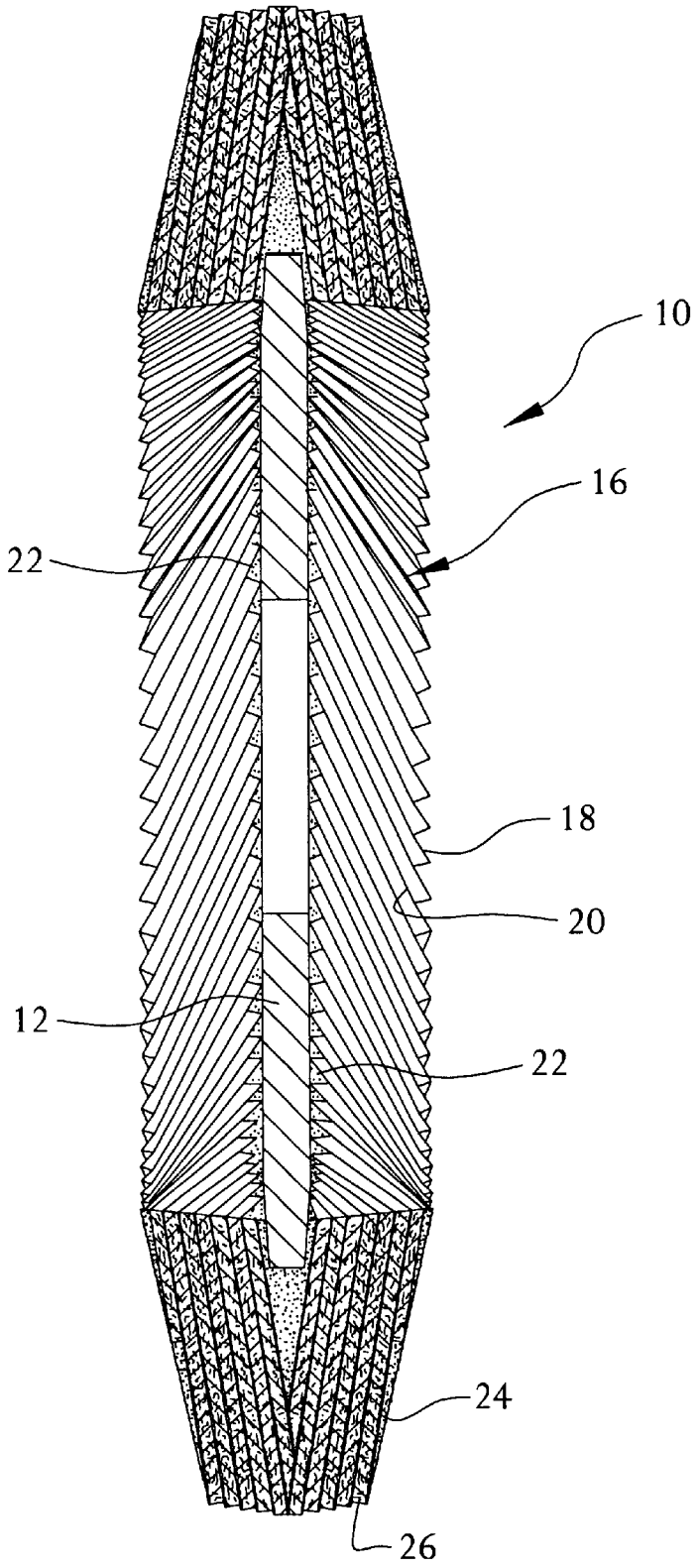
FIG. 3 is a cross-sectional view of the V-shaped finishing disc taken along lines 3—3 of FIG. 2.

Referring to FIG. 2 which illustrates one side of the flap disc 10, the abrasive flaps 16 are attached to the backing plate 12 and overlap one another in a circular pattern on the disc 10. As is readily apparent from the figure, the overlapping of the flaps 16 forms a fan-type pattern on the disc. As a result, the radially outer edge $\mathbf{16}_O$ of each flap is exposed more than the radially inner edge $\mathbf{16}_I$ of the flap. As shown in FIG. 3, the fan-type pattern of the flaps 16 also results in the outer edges $\mathbf{16}_O$ of the flaps being located closer to the mounting plate 12 than the inner edge $\mathbf{16}_I$. This results in the abrasive surface formed from the flaps 16 having a substantially frustoconical shape that angles toward the backing plate 12. Since the flap disc 10 includes flaps 16 on both sides of the backing plate 12, the abrasive surfaces defined by the flaps 16 on each side angle toward one another giving the flap disc 10 a substantially V-shaped cross-section.

Figure 4:
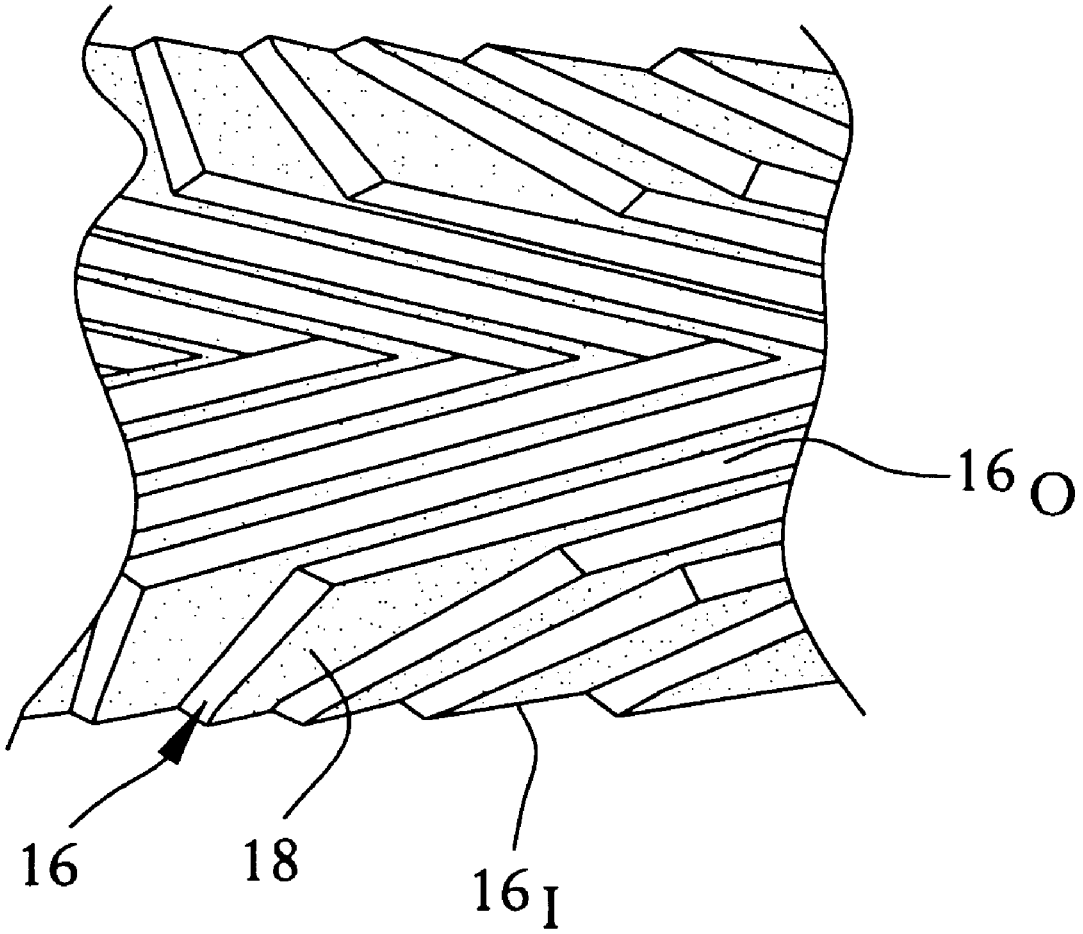
FIG. 4 is a partial plan view of the V-shaped finishing disc taken along lines 4—4 in FIG. 1.

In order to properly sand or finish an interior groove, such as a V-shaped groove, the flaps 16 must be mounted to the backing plate such that rotation of the disc 10 brings the abrasive particles into contact with the work surface. This is accomplished by overlapping the flaps 16 on each side of the disc 10 such that their abrasive surfaces face in the same circumferential direction (i.e., the direction of rotation of the disc). As a result, the flaps 16 form a herringbone pattern along the edge of the disc 10 as shown in FIG. 4.

Each abrasive flap 16 has an outer surface 18 and an inner surface 20. Although the abrasive flaps 16 are depicted as rectangular in shape, other shapes may be used without departing from the invention. The outer surfaces 18 define the finishing surface of the disc 10.

A portion of the inner surface 20 of each abrasive flap 16 is attached to the backing plate 12 by means of an adhesive 22. The adhesive 22 is preferably chosen to work well under the high pressure and temperature conditions present during a normal finishing operation. In the preferred embodiment, the adhesive 22 is an epoxy type of adhesive, such as Naftotec™ manufactured by Chemetall, or Araldite M8552 manufactured by Ciba.

Referring back to FIG. 3, one embodiment of the invention is shown wherein the abrasive flaps 16 have an abrasive finishing layer 24 which includes abrasive particles such as aluminum oxide. The finishing layer 24 is attached to a substrate 26, preferably by means of a resin binder such as Cascophen™ manufactured by Borden. In a preferred embodiment of the invention, the substrate 26 comprises a fiber coated with a resin binder to form a resin fiber layer. The resin is preferably a phenolic resin such as Cascophen™ and the fiber material is preferably a vulcanized cotton material. Other materials, such as fiberglass, may be utilized in the substrate so long as the chosen material is capable of breaking away after the abrasive particles have worn. The fiber substrate in this embodiment retains the abrasive particles until they are sufficiently worn, at which point the loads applied to the abrasive flaps 16 cause the particles to tear away and expose new abrasive material.

In one alternative embodiment of the invention, the substrate 26 comprises a non-woven abrasive fabric, such as crimped staple fibers sold under the registered trademark "Scotch-Brite" by the 3M Company of St. Paul, Minn. The finishing layer 24 is formed by bonding an abrasive particle and resin combination nation to the surface of the non-woven fiber substrate 26 as disclosed in U.S. Pat. No. 5,752,876. This type of material is commonly referred to as "surface conditioning".

In an alternate configuration of the non-woven fiber substrate embodiment discussed above, abrasive particles and resin may be located throughout the non-woven fabric of the substrate 26. Hence, the finishing layer 24, effectively, forms a substantial portion, if not the entire substrate 26. As the uppermost abrasive particles are torn off of the substrate, new abrasive particles will continuously be exposed to the work surface. The resin also assists in stabilizing the substrate 26 so as to provide a relatively rigid foundation for holding the abrasive particles.

When the flap disc 10 is inserted into a V-shaped groove, the outer edges $\mathbf{16}_o$ may come into contact with the work surface before the rest of the disc 10. As the outer edges $\mathbf{16}_o$ wear, they will tear off exposing the underlying abrasive flaps. The tearing away of the outer edges $\mathbf{16}_o$ of the flaps also reduces the width of the disc 10. The reduced disc 10 thickness allows the disc 10 to be inserted deeper into the groove, thereby permitting a larger portion of the flaps 16 to contact the work surface. Also, it may be desirable to vary the coarseness of the abrasive from fine to coarse.

Although the invention has been described and illustrated with respect to the exemplary embodiments thereof, it should be understood by those skilled in the art that the foregoing and various other changes, omissions and additions may be made therein and thereto, without departing from the spirit and scope of the present invention.

What is claimed:

1. A flap disc for use with a surface finishing tool, the tool having a drive shaft for transmitting rotary motion to the disc, wherein the disc comprises:

a backing plate for attaching to and being rotated by the drive shaft;

a plurality of first abrasive flaps radially disposed on a first side of the backing plate, each first abrasive flap having an outer surface and an inner surface, a portion of the inner surface being adhesively attached to the backing plate and a second portion of the inner surface being disposed on the outer surface of an adjacent first abrasive flap in an overlapping fashion so as to position the outer surface of the first abrasive flap at an angle to the backing plate; and a plurality of second abrasive flaps radially disposed on a second side of the backing plate, each second abrasive flap having an outer surface and an inner surface, a portion of the inner surface being adhesively attached to the backing plate and a second portion of the inner surface being disposed on the outer surface of an adjacent second abrasive flap in an overlapping fashion so as to position the outer surface of the second abrasive flap at an angle to the backing plate, wherein the outer surfaces of the first and second abrasive flaps face in the same circumferential direction, and wherein the first and second abrasive flaps are arranged so as to angle toward one another to define a substantially V-shaped finishing surface.

2. A flap disc according to claim 1 wherein the adhesive flaps are attached to the backing plate with an epoxy type adhesive.

3. A flap disc according to claim 1 wherein flaps include an abrasive finishing layer and a substrate.

4. A flap disc according to claim 3 wherein the abrasive finishing layer includes aluminum oxide abrasive particles, and wherein the substrate is made from resin fiber material.

5. A flap disc for use with a surface finishing tool, the tool having a drive shaft for transmitting rotary motion to the disc, wherein the disc comprises:

a backing plate for attaching to and being rotated by the drive shaft, the backing plate having first and second sides; and a first abrasive surface formed on a portion of the first side of the backing plate, the first abrasive surface tapering radially toward the backing plate, the first abrasive surface including a plurality of abrasive flaps mounted in an overlapping pattern circumferentially around the backing plate, each abrasive flap having an outer surface and an inner surface, a portion of the inner surface being adhesively attached to the backing plate and a second portion of the inner surface being disposed on the outer surface of an adjacent abrasive flap in an overlapping fashion so as to position the outer surface of the abrasive flap at an angle to the backing plate; and a second abrasive surface formed on a portion of the second side of the backing plate, the second abrasive surface tapering radially toward the backing plate, the second abrasive surface including a plurality of abrasive flaps mounted in an overlapping pattern circumferentially around the backing plate, each abrasive flap having an outer surface and an inner surface, a portion of the inner surface being adhesively attached to the backing plate and a second portion of the inner surface being disposed on the outer surface of an adjacent abrasive flap in an overlapping fashion so as to position the outer surface of the abrasive flap at an angle to the backing plate, wherein the outer surfaces of the abrasive flaps on the first and second abrasive surfaces face in the same circumferential direction, and wherein the abrasive flaps on the first and second abrasive surfaces are arranged so as to define a substantially V-shaped finishing surface.

6. A flap disc according to claim 5 wherein the adhesive flaps are attached to the backing plate with an epoxy type adhesive.

7. A flap disc according to claim 5 wherein flaps include an abrasive finishing layer and a substrate.

8. A flap disc according to claim 7 wherein the abrasive finishing layer includes aluminum oxide abrasive particles, and wherein the substrate is made from resin fiber material.

* * * * *